US006460980B1

(12) United States Patent
Hegedús et al.

(10) Patent No.: US 6,460,980 B1
(45) Date of Patent: Oct. 8, 2002

(54) LIQUID DISPENSING APPARATUS

(76) Inventors: György Hegedús, Wesselényi 4., H-H-1075, Budapest (HU); Albert Kocsis, 532 urca 7., H-H-1173, Budapest (HU); Gusztáv Flórian, Kálmán u. 96. H-H-2120, Dunakeszi (HU)

( * ) Notice: Subject to any disclaimer, the term of this patent is extended or adjusted under 35 U.S.C. 154(b) by 0 days.

(21) Appl. No.: 09/623,735

(22) PCT Filed: Mar. 2, 1999

(86) PCT No.: PCT/HU99/00015

§ 371 (c)(1),
(2), (4) Date: Nov. 20, 2000

(87) PCT Pub. No.: WO99/46126

PCT Pub. Date: Sep. 16, 1999

(30) Foreign Application Priority Data

Mar. 9, 1998 (HU) ..... 9800508

(51) Int. Cl.[7] ..... B41J 2/045
(52) U.S. Cl. ..... 347/68
(58) Field of Search ..... 347/10, 27, 68–69, 347/70, 104; 417/322; 239/102.2

(56) References Cited

U.S. PATENT DOCUMENTS

| | | | | | |
|---|---|---|---|---|---|
| 3,653,598 | A | | 4/1972 | Waldrum | 239/229 |
| 3,667,678 | A | | 6/1972 | Haskell | 239/102 |
| 3,924,974 | A | * | 12/1975 | Fischbeck et al. | 417/322 |
| 4,229,748 | A | | 10/1980 | Williams et al. | 346/75 |
| 4,349,830 | A | | 9/1982 | Rudd, III | 346/140 |
| 4,375,347 | A | | 3/1983 | Lombardo et al. | 425/10 |
| 4,390,484 | A | | 6/1983 | Lombardo et al. | 264/9 |
| 4,439,780 | A | * | 3/1984 | DeYoung et al. | 347/68 |
| 4,485,388 | A | * | 11/1984 | Sayko | 347/68 |
| 4,498,089 | A | * | 2/1985 | Scardovi | 347/10 |
| 4,563,688 | A | * | 1/1986 | Braun | 347/27 |
| 4,583,101 | A | | 4/1986 | Braun | 364/75 |
| 4,605,167 | A | * | 8/1986 | Maehara | 239/102.2 |
| 4,646,104 | A | | 2/1987 | Braun | 346/1.1 |
| 4,683,477 | A | * | 7/1987 | Braun et al. | 347/68 |
| 4,815,661 | A | | 3/1989 | Anthony | 239/102.2 |
| 4,897,673 | A | | 1/1990 | Okabayashi et al. | 346/140 |
| 5,049,404 | A | | 9/1991 | Kisler et al. | 427/30 |
| 5,682,191 | A | * | 10/1997 | Barrett et al. | 347/104 |
| RE36,667 | E | * | 4/2000 | Michaelis et al. | 347/69 |
| 6,196,656 | B1 | * | 3/2001 | Ghosh et al. | 347/27 |
| 6,241,346 | B1 | * | 6/2001 | Takahashi | 347/70 |

FOREIGN PATENT DOCUMENTS

| | | | | |
|---|---|---|---|---|
| EP | 0026688 | A | 4/1981 | B41J/3/04 |
| EP | 0285794 | A | 10/1988 | B05B/5/08 |
| GB | 2024724 | A | 1/1980 | |
| JP | 7314665 | A | 12/1995 | B41J/2/015 |
| RU | 94042868 | A1 | 11/1996 | |
| SU | 100752 | A | 3/1983 | |
| WO | WO96/31289 | | 10/1996 | B05B/11/02 |

* cited by examiner

*Primary Examiner*—John Barlow
*Assistant Examiner*—K. Feggins
(74) *Attorney, Agent, or Firm*—McDonnell Boehnen Hulbert & Berghoff

(57) ABSTRACT

There is disclosed a device for dispensing liquids, in particular dyes or inks. The device comprises a liquid tank, a dispensing nozzle, and a liquid conduit with an end connected to the liquid tank for supplying liquid from the liquid tank to the dispensing nozzle. The device is provided with vibrator means, particularly a piezoelectric transducer. The transducer is used for inducing a vibrating action of the dispensing nozzle, and by the vibrating action resulting in an acceleration of the nozzle, to an extent that is sufficient to cause the detachment of the liquid from the nozzle, The invention also relates to a printing head and system utilising the inventive dispensing device.

37 Claims, 6 Drawing Sheets

Fig. 6a
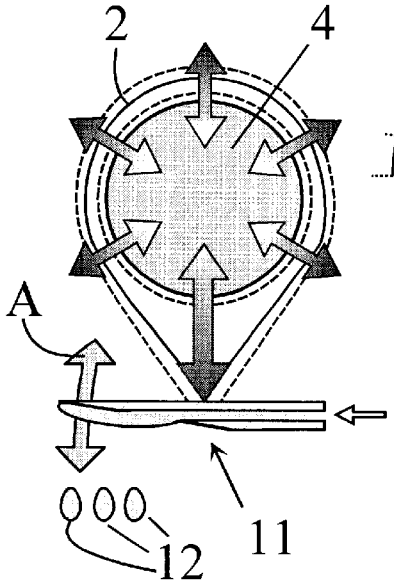
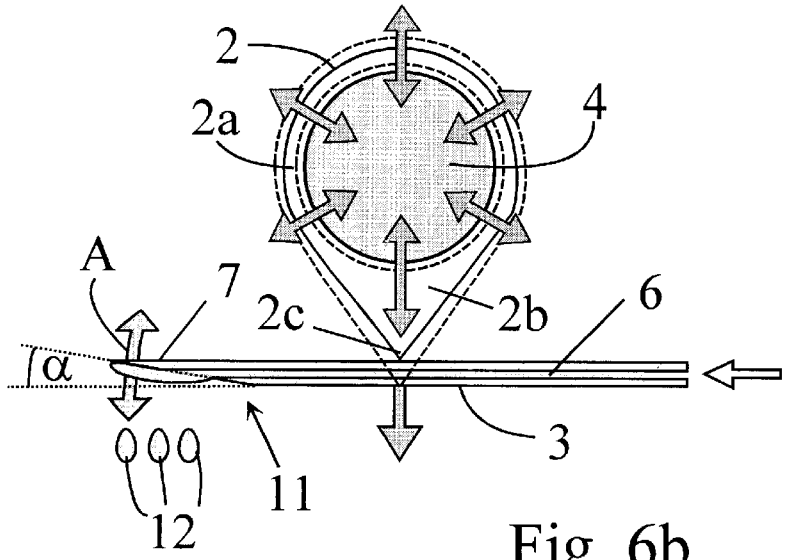
Fig. 6b
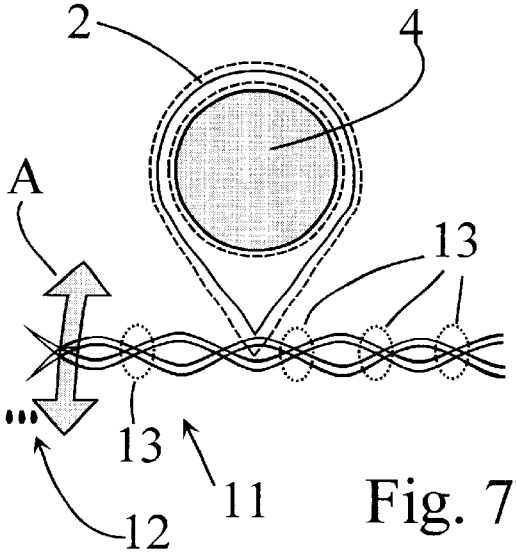
Fig. 7b
Fig. 7a
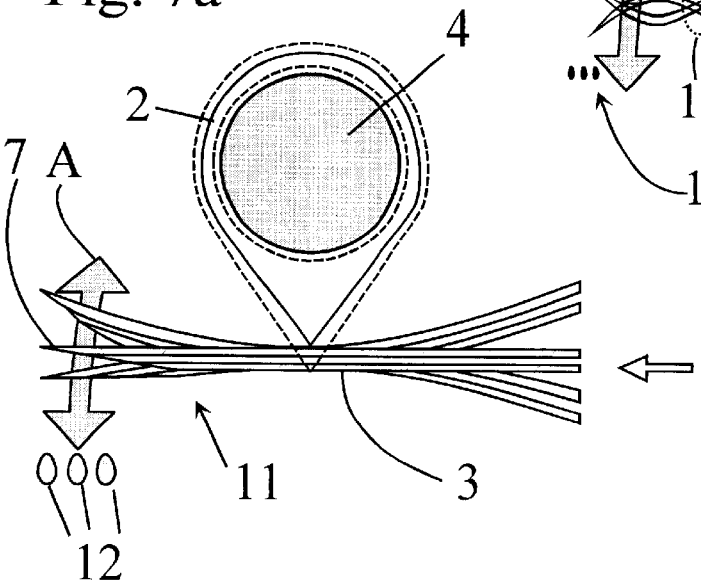

Fig. 9a
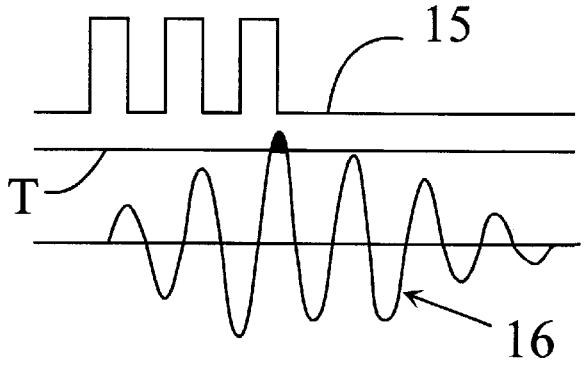
Fig. 9b
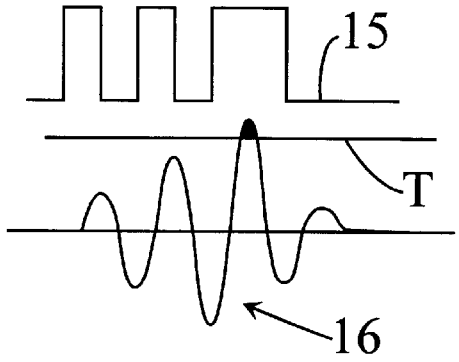
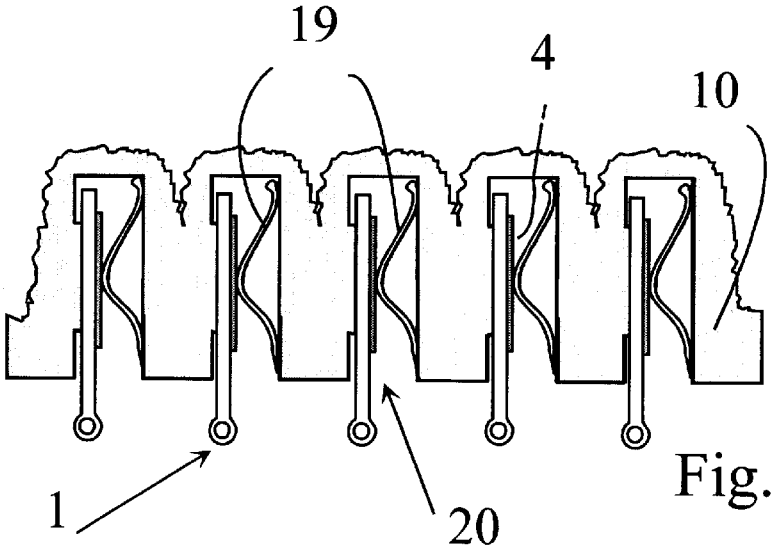
Fig. 11
Fig. 12a
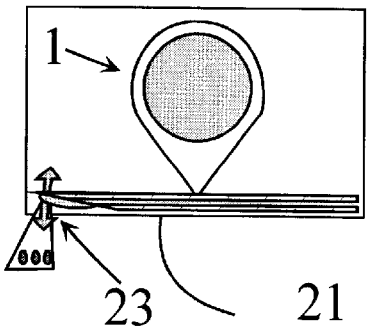
Fig. 12b
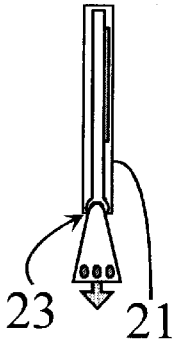
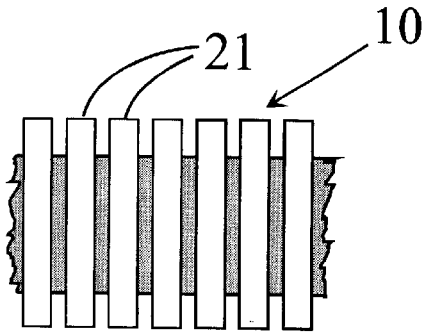
Fig. 13a

LIQUID DISPENSING APPARATUS

TECHNICAL FIELD

The object of the invention is a device for dispensing liquids. The device according to the invention comprises a liquid tank, a dispensing nozzle, and a liquid conduit with an end connected to the liquid tank for supplying liquid from the liquid tank to the dispensing nozzle. The device is especially suited for the accurate dispensing of small amounts of liquid, in particular dyes, medicine or similar liquid that must be dispensed in very exact, controlled portions. The invention also relates to a printing head and printing system using the inventive dispensing device.

BACKGROUND ART

Various types of liquid dispensing devices having a dispensing nozzle are known in the art. U.S. Pat. No. 3,653,598 to Waldrum discloses a vibrating spray apparatus designed for use in agricultural spray systems. This known apparatus comprises a spray tube with an associated vibration transmitting device. The free end of the spray tube is caused by the vibration transmitting device to move in an orbital path. Liquid is discharged from the spray tube during the vibration, under the effect of the pressure in a remote liquid tank. This known apparatus is suitable for providing a very uniform distribution of the liquid during the spraying. The device is not suitable for dispensing small amounts of liquid in a well-controlled manner.

Printing technology is a special area where various liquid dispensing techniques are used. Printed images on paper or other substrates is in constant demand, which is supported strongly by IT and printed products are used daily in practically all areas of the economy. The demand is likely to remain or even increase in the future as well. Significant efforts are invested in the development of high-speed and cost-saving printing systems. Research is largest in two different directions. The first is the combination of conventional printing technologies with digital pre-pressing, and the second one is the development of entirely digitised printing systems.

The conventional offset printing system, for instance, is advantageous from the cost-benefit point of view only if high volumes are printed. The cost of pictures printed with modern digital systems are less dependant on volume, once the systems are installed. However, the large initial costs mean that the total production costs per piece are still higher as opposed to the conventional systems. As a further disadvantage, the dyes of the currently used ink-jet and bubble-jet printing technologies are inferior to traditional techniques with respect to water and UV resistance. While desktop colour printers are becoming commonplace, at the same time, there is a long-felt need for printing techniques which would make possible the cost-effective, fast printing of very few, even single items, combined with a capacity to print large-scale, i. e. large sized products. Examples of such products are large posters for advertising purposes.

Liquid dispersing or spraying technology using ultrasound generated by a piezo-electric transducer is known in the art. In simple terms, ultrasound liquid dispensing is based on the following phenomenon: If a mechanical vibration with a high amplitude can be achieved it is capable of dispersing the liquid to drops by overcoming the surface tension. There are two basic types of ultrasound liquid dispersion:

High frequency (approx. 1 MHz or higher) vibration energy radiating from the transducer is concentrated in the liquid in order to achieve the necessary energy density. i. e. pressure, for dispersion.

In the techniques involving a lower frequency, the necessary energy density is achieved range by using different types of solid concentrators, and the liquid is lead to a surface. which is vibrating at a relatively high amplitude.

The presently available ultrasonic liquid dispersers have a number of disadvantages. Their external dimensions are rather large, and therefore their application in the printing industry is limited. Also, because of their large size, the vibrating mass is also large, which results in a long activation time. Besides all these disadvantages, the problem of adjusting the pixel size created by the ejected liquid droplets is not solved. Cleaning of the device, replacement of the parts and a relatively complicated electric system cause problems as well.

U.S. Pat. No. 4,815,661 to Anthony relates to an ultrasonic spraying device with a body and a piezo-electric vibrating core. The vibrations generated by the vibrating core are transmitted to a spray nozzle. The liquid to be sprayed is atomised by the vibration of the spray nozzle. The liquid is sprayed out as the result of the internal pressure within the liquid, the internal pressure being caused by the vibrating core.

U.S. Pat. No. 4,897,673 to Okabayashi et al. teaches a method for connecting a nozzle tube of an ink jet printer with a piezoelectric element. There is disclosed a nozzle tube in operating connection with a piezoelectric element, which latter causes the periodic contraction and expansion of the nozzle tube, and thereby the discharge of liquid (ink) from the nozzle tube. As above, the liquid is discharged under pressure which is created within the nozzle tube.

As mentioned above, these known techniques are not suitable for large-scale, fast printing. Therefore, the principal objectives of the invention are the following:

Achieving a liquid drop size, or a pixel size on paper or on other substrates, which could be varied between wide ranges. Most specifically, it is sought to provide a device which produces a variable tone on the printed pixels.

Creating a dispensing device with a reduced size in at least one dimension, allowing the positioning of the liquid dispensing units closely next to each other. In this manner, continuous parallel printing could be achieved in a full width of a printing substrate. In order to achieve high printing speeds, it was sought to reduce the time of creating a liquid drop.

Further, it was sought to provide a system without the need for an elaborate electric system, combined with a possibility to apply widely different liquid types. Also, it was desired to create a system which can be connected to and controlled by a computer, and solves the problems of cleaning and part replacement.

SUMMARY OF THE INVENTION

According to a first aspect of the invention, the above goals are achieved with a device comprising a liquid tank, a dispensing nozzle, and a liquid conduit with an end connected to the liquid tank for supplying liquid from the liquid tank to the dispensing nozzle. According to the invention, the device further comprises vibrator means for inducing a vibrating action of the dispensing nozzle, and by the vibrating action resulting in an acceleration of the nozzle sufficient to cause the detachment of the liquid from the nozzle.

The invention also extends to a liquid dispensing device with essentially the same basic features, but without the liquid tank. This modified inventive device connects to an external liquid tank.

In a preferred embodiment, the liquid conduit is integral with the dispensing nozzle. Advantageously, a free end of the liquid conduit is cut at an angle, and the cut free end functions as the dispensing nozzle. Alternatively, the nozzle could be formed as a free end of the liquid conduit having an decreasing diameter towards the free end, at least in a part of the conduit adjacent to the free end.

In the most preferred embodiment, the vibrator means comprises a piezo-electric transducer, and the liquid conduit is a hollow metal tube. In this case the nozzle is at the vibrating end of the tube. The end may be cut at an angle or its cross-section may be gradually decreasing.

In the device according to the invention, it is foreseen that the transducer is attached to the liquid conduit through a resonator. It is most preferred that the transducer, the resonator and the conduit constitute a resonating unit.

In a specific embodiment, the resonator is a flat steel plate attached directly or indirectly to the liquid conduit adjacent to the free end. Its major advantage over the three dimensional i.e. the spatial resonators is not only the small lateral size but also the much shorter activation time, which allows the pulsed operation of the liquid dispensing apparatus and makes a controlled liquid transport in a short time possible.

The plate-resonator of the invention is fastened to the liquid conducting tube which has a smaller weight than the resonator itself, and therefore the tube vibrates at a higher amplitude. The nozzle is formed at a free end on the liquid conducting tube, and vibrates at the maximum amplitude. However, this system dispenses liquid properly if the right amount of liquid is directed to the active parts i.e. to the nozzles. If this quantity is more or less than the optimal, the capacities of the system remain unexploited. The liquid supply to the nozzle is influenced by the capillary effect and the hydrostatic pressure in the tube. Since the capillary effect is difficult to control, it is suggested that the device should comprise means for varying the hydrostatic pressure of the liquid in the liquid tank and/or in the liquid conduit.

In a most preferred embodiment of the device according to the invention, the transducer is a circular disk-shaped piezoelectric transducer, and the steel plate is substantially drop-shaped with a circular part having a triangular extension integral with the circular part. The transducer is attached parallel to the circular part in a concentric position and the apex of the triangular extension is attached to the liquid conduit.

Facilitating computer control of the device, it may further comprise externally controlled driver means for driving the transducer at predetermined, variable frequencies.

A second aspect of the invention relates to a printing head comprising multiple liquid dispensing means for dispensing dye in controlled amounts in predetermined, controlled locations of a printing medium. According to the invention, the liquid dispensing means comprises liquid dispensing device according to the first aspect of the invention. In a preferred embodiment, the printing head comprises parallel slots for receiving the liquid dispensing devices, and contact springs for fastening the liquid dispensing devices to the wall of the slots.

In order to facilitate variable pixel size and/or variable tone on different substrates, the printing head comprises multiple dispensing devices arranged in a line, and further comprises moving means for translating movement of at least the nozzles of the dispensing devices in a direction parallel to the line. It is also suggested to include adjustment means for an additional translating movement of the nozzles of the dispensing devices in a direction perpendicular to the line, simultaneously or individually for each nozzle. This is especially useful to adjust the pixel size (width) to the pixel resolution (number of pixels per unit length) and/or to the tone (coverage).

The invention also relates to a printing system with a printing medium feeding mechanism and at least one printing head for dispensing dye in controlled amounts in predetermined, controlled locations of the printing medium, with a printing head according to the second aspect of the invention. It is suggested to utilise multiple printing heads, with each printing head dedicated to a predetermined colour.

The present invention is suitable for the continuous or pulsed dispensing of small quantities of liquid. The invention ejects the liquid particles as droplets towards the target medium with a great energy and with a high repetition rate, and the ejected quantities of the liquid can be adjusted accurately. The liquid may be a solvent (e.g. water, acetone, etc.), a dye solution (e.g. ink), emulsion or suspension (e.g. pigmented ink).

Due to the above-mentioned features, the apparatus is best suitable for printing purposes, and the application of the inventive device in printing systems puts a novel printing process into practice. However, pharmaceutical and medical purposes are also considered as areas of application, as well as any other areas where relatively small quantities of liquid have to be dispensed with great accuracy and without contamination.

BRIEF DESCRIPTION OF DRAWINGS

By way of example only, an embodiment of the invention will now be described with reference to the accompanying drawing, in which FIGS. 6*a–b* show two different embodiments of the resonator-liquid conduit unit, FIGS. 7*a–b* illustrate the operating principle of the dispensing device according to the invention, FIGS. 9*a–b* illustrate the shape of the driver signal to achieve a single liquid discharge.

FIGS. 12*a–b* illustrate another embodiment of a pixel unit for mounting in a printing head according to the invention.

FIGS. 13*a–b* show a cross-section across a part of another printing head, and a schematic perspective view of the printing head, using the pixel units of FIGS. 12*a*,12*b*, FIG. 14 illustrate the time-dependence of the pixel coverage (tone) during a liquid discharge cycle in the device according to the invention.

BEST MODE FOR CARRYING OUT THE INVENTION

Figure 1:
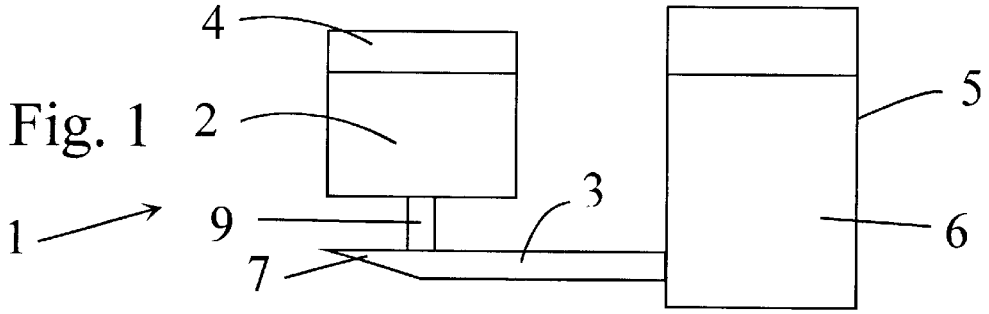
FIG. 1 is a schematic diagram illustrating the basic elements of the liquid dispensing device according to the invention.

With reference to FIG. 1, there is shown the principal structure of a liquid dispensing device 1. The device 1 is equipped with a resonator 2 in the form of a flat metal plate, attached to a liquid conduit having a nozzle 7. The liquid conduit is made as a liquid conducting tube 3, with a free end ending in the nozzle 7, and the other end connected to a liquid tank 5. The liquid 6 to be dispensed by the nozzle 7 is held by the liquid tank 5.

The device 1 is also provided with vibrator means, here formed as a transducer 4. The vibration of the resonator 2 is induced by the transducer 4, which latter is fastened to the resonator 2. The transducer 4 is preferably a piezoelectric transducer, e.g a piezo-ceramic plate. The resonance mode of the resonator 2—thickness mode, radial mode or bending mode—is a matter of construction. However, in a preferred embodiment, a radial mode is used, as will be shown below. The liquid conducting tube 3 is fastened to the resonator 2 with the coupling part 9. The resonator 2 and the liquid conducting tube 3 constitute a resonating unit, i. e. a mechanical vibrating system having a specific resonance frequency.

One end of the liquid conducting tube 3 is immersed in the liquid 6 of the liquid tank 5. The cross-section of the other end of the liquid conducting tube 3 is decreasing in order to form a nozzle, or, as with the preferred embodiments of the drawings, the end of the tube 3 is cut at a sharp angle. The nozzle 7 is at the vibrating end of the liquid conducting tube 3.

The nozzle 7 serves to transmit the vibrational energy from the resonator 2 to the liquid. It is also important to adjust the resonant characteristics of the nozzle 7 to the characteristics of the liquid (flow parameters, mass, viscosity, capillary constant, surface tension, etc.) Therefore, the nozzle 7 is a vibrating part with a frequency adjusted to the resonator's resonance frequency (a joined vibrating system). In some cases, the resonator 2 may be connected to the nozzle 7 with a coupling part 9. In this case, the coupling part 9 also forms a part of the vibrating system. The nozzle's 7 vibration energy and the degree of efficiency depend on the proper vibrational design of the coupling part 9. It must be noted that the coupling part 9 need not necessarily be made separate from the resonator 2 or the nozzle 7, but may be an integral part of them.

The conducting of the liquid to the nozzle 7 may be effected in different ways. In order to avoid difficulties with the calibration and to make cleaning simpler, it is suggested to place the nozzle 7 on the vibrating end of the liquid conducting tube 3. The liquid conducting tube 3 has a decreasing cross-section at the free end, functioning as a bending mode concentrator, because if the cross-section of the liquid conducting tube 3—and as a result, the specific mass to the length—is decreased appropriately, the energy balance requires an increase in the vibrational amplitude. This decrease of the cross-section is made by cutting the end of the tube in a sharp angle, or by reducing the inner diameter and/or the wall thickness of the tube at the nozzle end.

Liquid supply is provided by over-pressure in the liquid 6, as well as the capillary effect in the liquid conducting tube 3. At the nozzle 7 end of the liquid conducting tube 3 oversupply is prevented by the surface tension which keeps a self-regulating balance with the over-pressure at the other end of the liquid conducting tube 3.

Figure 2A:
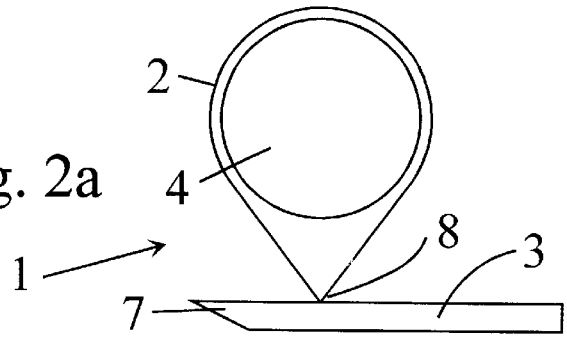
FIGS. 2*a–b* show side and front views, respectively, of a preferred embodiment of the device according to the invention.
Figure 2B:
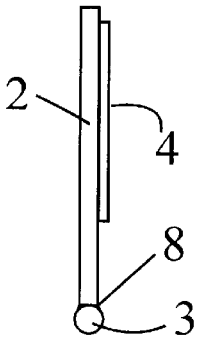
Figure 3:
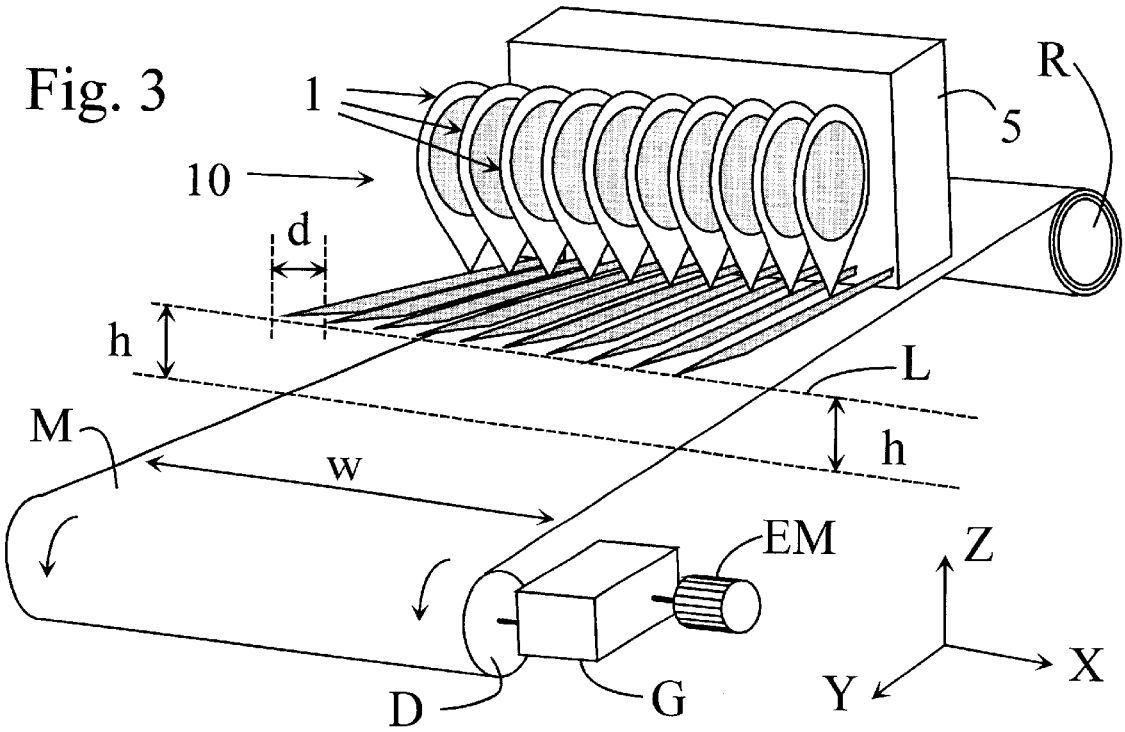
FIG. 3 is a schematic perspective view of a row of dispensing devices, in the configuration used in the printing head according to the invention.

As shown in FIGS. 2*a–b*, the liquid dispensing device according to the invention may be realised as a unit independent from the liquid tank 5. E. g. several such devices may be connected to a common liquid tank 5, as seen in FIG. 3.

The dispensing apparatus according to the invention is remarkably flat. Actually, it may almost be regarded as a two dimensional body, as best seen in FIG. 2*b*. As far as application in printing systems is concerned, this flat shape is of great importance. In this case the transducer 4 piezo ceramic is attached to the resonator 2, preferably by adhesion.

The resonator 2 transfers its vibrational energy to the liquid conducting tube 3 at the point-welded junction 8. The longitudinal vibrating mode of the resonator 2 is transformed into bending mode, i. e. transversal vibration of the tube 3, at the junction 8. It is obvious that the liquid conducting tube 3 should be dimensioned to appropriate vibrating frequency, and it should be adjusted to the resonance frequency of the whole system.

In the case of this construction the nozzle 7 is at the vibrating end of the liquid conducting tube 3, as best shown in FIGS. 7*a* and 7*b*.

The liquid dispensing device according to the present invention, especially the embodiments of FIGS. 2*a–b*, can be used in printing heads. The basic arrangement of the dispensing devices 1 within a printing head 10 is shown in FIG. 3.

Here, a printing head 10 comprises multiple liquid dispensing devices 1 arranged along a line L, with the planes of the resonators 2 arranged parallel to each other. The nozzles 7 are at a certain height h above the printing medium M. Since the devices 1 are very flat, the distance d between them is rather small, in the range of 1 mm. This means that a large number of pixels may be printed across the full width w of the printing medium M. The liquid conducting tubes 3 are connected to a common liquid tank 5. Alternatively, periodically every four or three device 1 may be connected to a common liquid tank, e.g. corresponding to the CMYK or RGB colours.

The printing medium M, e. g. a sheet of paper drawn from a paper roll R is translated under the printing head 10 by a feeding mechanism known per se. The feeding mechanism may be realised with a gear G and a motor EM driving the pulling roll D.

In order to be able to adjust the lateral resolution of the printing head 10, it is foreseen to provide moving means (not shown in FIG. 3) for translating movement of at least the nozzles of the dispensing devices in a direction parallel to the line L, along the X co-ordinate. It is also suggested to provide adjustment means (not shown in FIG. 3) for an additional translating movement of the nozzles 7 of the dispensing devices in a direction perpendicular to the line L (along the co-ordinate Z), simultaneously or individually for each nozzle. By "additional translating movement" it is meant to define a movement which is additional relative to the oscillating action of the nozzle along the Z-axis, a substantially constant component added to the alternating movement. This adjustment means could offer an alternative method to adjust the pixel size on the printed medium, by varying the height h of the nozzles 7 above the medium M.

It must be noted that theoretically the movement of the printing head 10 and/or the nozzles 7 along the Y co-ordinate is also possible. However, in the preferred embodiment the relative movement between the printing head 10 and the printing medium M is achieved by moving the printing medium M, and keeping the printing head 10 in a fixed position along the Y-coordinate.

We have built several prototypes of the printer head 10, in a so-called parallel printer, where the dispensing devices 1 within the printing heads 10 are placed in raster size distance (distance d) from each other. We have carried out reliability as well as life cycle tests on the printing heads, and it was found that the printing heads with the liquid dispensing devices according to the invention function reliably and accurately.

The printing heads 10 according to the invention are included in a printing system (not shown in detail). The system includes a printing medium feeding mechanism and at least one printing head for dispensing dye in controlled amounts in predetermined, controlled locations of the printing medium, like paper. Colour printing is achieved by using multiple printing heads, with each printing head dedicated to a predetermined colour. Using a configuration similar to that shown in FIG. 3, several printing heads 10 could be placed after each other, along the direction of the relative movement between the printing head 10 and the medium M (the Y direction in FIG. 3). The co-ordination of the printing between the heads is performed by a computer.

It must be noted that the distance d between the dispensing devices 1 in the printing head may be larger than the actual pixel width p (see FIGS. 8*a–c* and FIG. 14.). In this case, known methods are applied to ensure that the total area of the printing medium M is reached by the nozzles of the printing head 10, and in this manner the achieved resolution may be actually better than the physical distance between the liquid dispensing locations, i. e. the distance d between the nozzles 7. Such methods may include a slight sideways movement of the printing head or the medium, during several passes of the printing head above the medium. Alternatively, the printing head may move sideways several times in a single pass of the medium, similarly to the operation of known desktop inkjet printers. Such methods are known in the art per se, and are not part of the invention.

The details of the structure and the operation of the liquid dispensing device according to the invention will be explained below.

Figure 4A:
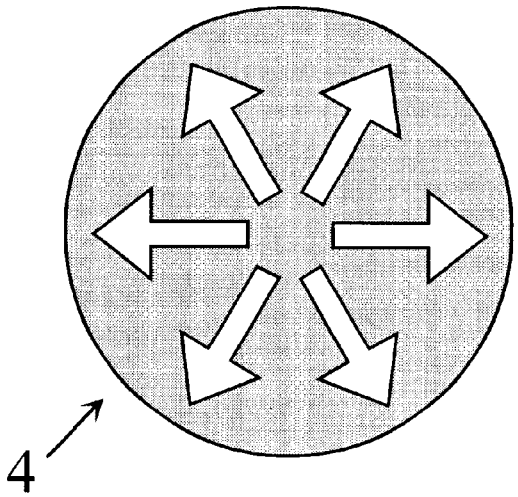
FIGS. 4*a–b* illustrate a proposed embodiment of the vibrator means used in the device according to the invention.
Figure 4B:
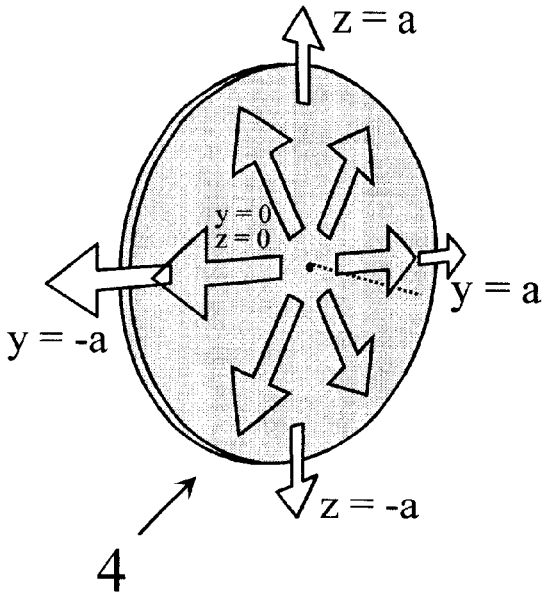
Figure 5:
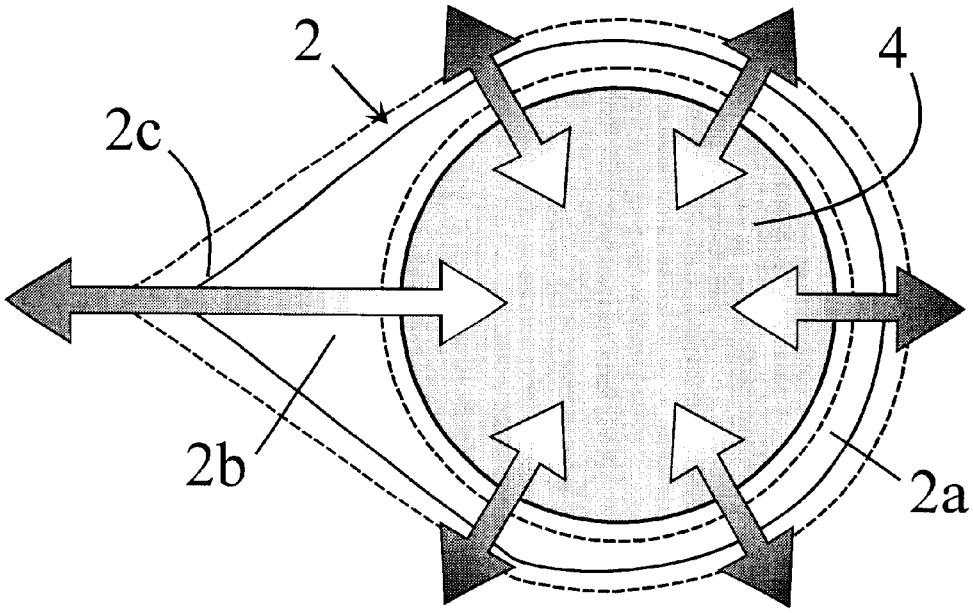
FIG. 5 is a side view of a transducer-resonator assembly, showing the operating principle of the resonator.

FIGS. 4*a* and 4*b* show a side and perspective view of the transducer 4. In the most preferred embodiment, the transducer 4 is a flat piezo-electric disk, e.g. a PZT transducer. It is driven in a radial mode, as indicated by the arrows. In this mode, the circumferential points of the disk oscillates in the radial directions. As shown in FIG. 5, the resonator 2 attached to the transducer 4 is substantially drop-shaped with a circular part 2*a*, and a triangular extension 2*b* integral with the circular part 2*a*. The transducer 4 is attached to the circular part 2*a* of the resonator 2 in a parallel, concentric position.

As best seen in FIG. 5 and FIGS. 6*a,b*, the apex 2*c* of the triangular extension is attached to the liquid conduit 3. The peripheral points of the resonator will also vibrate due to the excitation by the transducer 4. This effect is indicated by dotted lines and the arrows in FIG. 5 and in the following drawings.

The liquid conducting tube 3 may be connected to the resonator 2 in a number of ways. E. g. it is possible to attach the resonator 2 to the tube 3 adjacent to its free end, close to the nozzle 7. In this case the tube 3 may remain relatively short, with a small mass. This arrangement is shown in FIG. 6*a*. But practice showed that best results may be achieved with a longer tube 3, if the resonator 2 is attached in a distance from the nozzle 7, and the free end of the nozzle 7 is allowed to resonate. This results in a larger vibrating amplitude of the nozzle 7, and consequently, better dispensing efficiency. This arrangement is shown in FIG. 6*b*.

The physical principle of the novel dispensing technique according to the invention is the following (see FIG. 6*b*):

The liquid 6 flows into the tube 3 due to the capillary effect and the pressure in the liquid tank 5. As the transducer 4 is excited with an appropriate frequency, the vibration of the transducer 4 is transmitted to the resonator 2 and the connected tube 3. The free end 11 of the tube will start to vibrate as well. If the driving frequency is at or close to the resonating frequency, the vibrating amplitude will be relatively great. Since the acceleration of a vibrating system is linearly proportional to the amplitude (both chance sinusoidally, and in the same phase), the acceleration of the free end 11 will be also great. Eventually, the acceleration force (actually the inertia force of the liquid resulting from the acceleration of the nozzle) acting on the liquid 6 at the nozzle 7 will be sufficient to overcome the capillary adhesive forces, which would otherwise keep the liquid 6 attached to the nozzle 7, and the liquid particles will detach from the nozzle 7 in the form of minuscule droplets 12. The detached droplets 12 will keep the direction and velocity at their last moment when they were attached to the nozzle 7, and will be ejected in a direction substantially perpendicular to the tube 3, in the plane of the vibration. Now due to the angled cutting of the tube 3 at the nozzle 7, the major part of the liquid will be ejected in one direction only (downwards on the FIGS. 6 to 8.). The amount of the ejected liquid (dye) is essentially linear with the time of the excitation (see FIGS. 8*a–c* and 14), because the pressure and the capillary effect will continuously supply the new amount of the liquid from the liquid tank.

If the quantity of the liquid exceeds the optimal level, the performance of the system may deteriorate. The unit comprising the resonator and the nozzle operates optimally as a liquid dispenser only if the right amount of liquid is conducted to it. Liquid supply is optimal if the ejected liquid quantity is supplied in a short time without bringing more liquid to the nozzles than required. The problem of the controlled liquid supply is solved by a slight over-pressure created in the liquid tank, as well as the capillary effect in the liquid conducting tube. Oversupply is prevented because the surface tension of the liquid at the end of the nozzle 7 is in self-regulating balance with the over-pressure at the other end in the liquid tank 5. This structure enables the adjustment of the liquid quantity by over-pressure. It must be noted that choosing the diameter of the nozzle and the tube properly, this over-pressure may be kept at a relatively small value, e.g. in the order of $10^2$ Pa. Since this corresponds to the hydrostatic pressure of a water column with a few cm's height, this small value is achieved by the hydrostatic pressure of the liquid itself in the liquid tank. This means that relatively simple control means are sufficient to keep a certain level of the liquid in the liquid tank. The controlled liquid level will automatically provide the exact value of the over-pressure which is necessary for the proper functioning of the nozzles.

FIGS. 7*a* and 7*b*, show the applicable resonating modes of the liquid conducting tube 3. Theoretically, both the fundamental frequency (FIG. 7*a*) and the higher harmonics (FIG. 7*b*) may be used. If the tube 3 is driven on a fundamental frequency, the liquid may be conducted to the tube 3 via an intermediate flexible tube (not shown in FIG. 7*a*), because the end opposite to the free end 11 will also vibrate with a relatively large amplitude. Practice showed that it is better to use a higher harmonic of the tube having a base frequency of approx. 200 KHz. In this case standing nodes 13 will form on the tube 3, and in such a node 13 the liquid tank 5 may be attached to the tube 3.

Figure 8A:
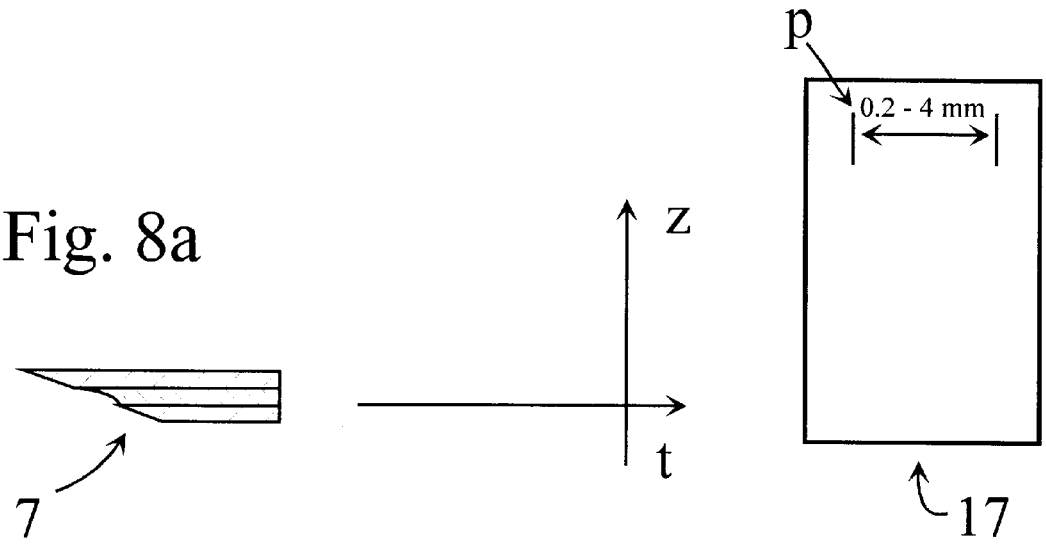
FIGS. 8*a–c* illustrate the adjusting of the pixel tone with the device according to the invention.
Figure 8B:
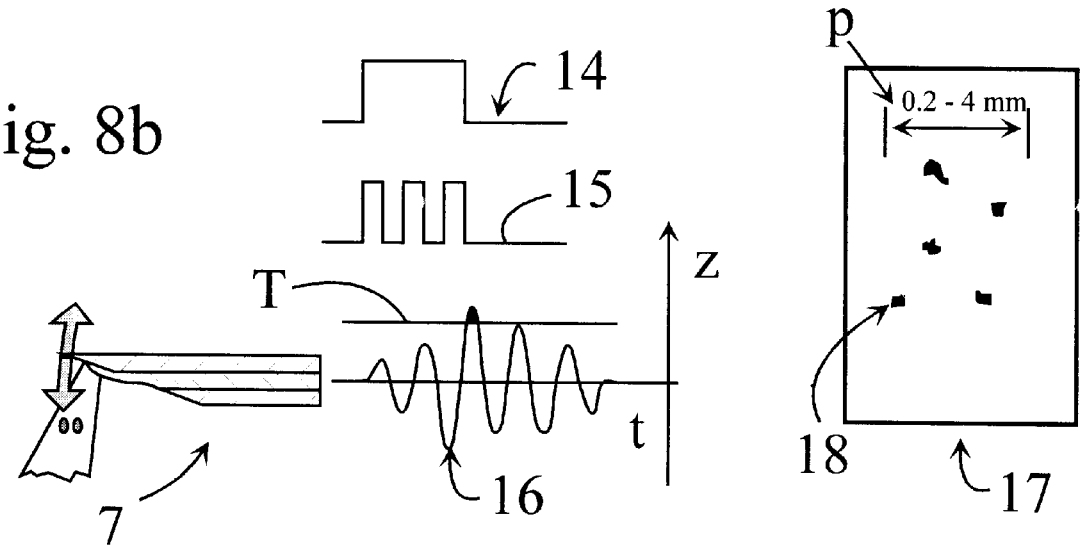
Figure 8C:
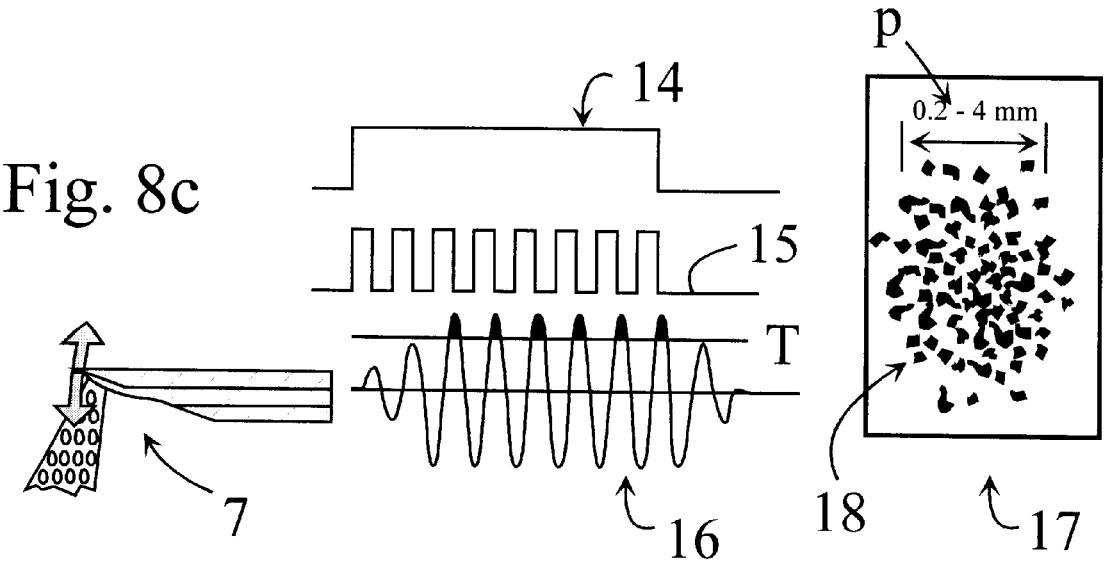

An important feature of the liquid dispensing device according to the invention that the density of a pixel may be varied. This means that even if the pixel size generated by the inventive device is somewhat larger than the pixel size achievable with other, e.g. ink-jet technologies, the resulting coverage (density or tone) of a pixel will be much "smoother" than with other techniques. This effect is especially significant when photographic images are printed. The process is illustrated in FIGS. 8*a* to 8*c*. FIG. 8*a* show the nozzle 7 in the inactive state, when no liquid (dye or ink) is ejected, and the pixel 17 is not covered. The nozzle 7 is activated by a control signal 14. The control signal 14 is the input signal of an appropriate driving electronics (not shown), which in turn will supply the driver signal 15 to the transducer 4 of the device. The driver signal 15 is an AC signal with the resonance frequency, and will cause the vibration of the nozzle 7. The amplitude (and acceleration) of the nozzle 7 is shown by the amplitude-time function 16. After a few oscillations, which takes about 60 $\mu$s in a practical system, the nozzle will reach a threshold T, above which the acceleration force due to the oscillating movement of the nozzle will surpass the adhesion force between the nozzle and the liquid, and liquid droplets will be detached from the nozzle. The time to reach the threshold T from the inactive state is termed as the activation time $t_1$ of the nozzle 7. The droplets are ejected with a great energy towards the printing medium, and form a pixel 17 with the average width P. The size of the liquid droplets 18 are approx. 10 $\mu$m, while the width P is between 0.2–4 mm, depending of the geometrical dimensions and the resonance parameters of the whole assembly (height h above the medium, see FIG. 3, size and shape of the tube 3 and the nozzle 7, resonant frequency, etc.)

In a specific tested assembly, the following parameters were used: The metal tube was made of steel according to the Hungarian Norm KO36 (used mainly for medical injection needles). The length of the tube was 27 mm, outer diameter 0.9 mm, inner diameter 0.5 mm. The nozzle was cut with an angle $\alpha$ of 20° (see FIG. 6*a*). The used ink was a pigmented water-based dispersion ink, with the brand name IDRO ET, produced by the Italian company Colorprint. The ink was diluted with water in the ratio 5:1. The PZT transducers were driven with 200 kHz, using a standard TL-level input driver circuit.

Figure 14:
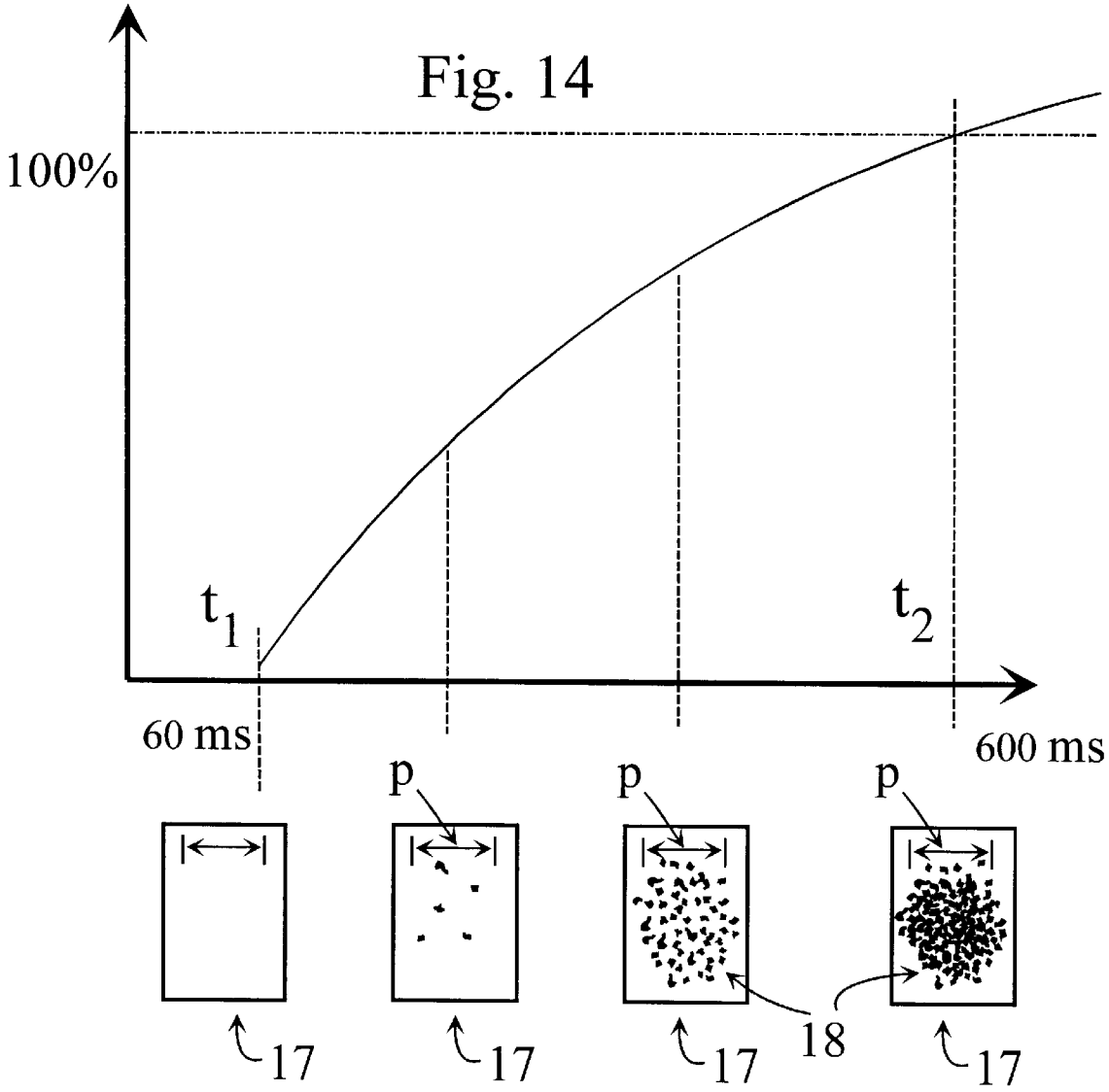

As shown in FIGS. 8*b*, 8*c*, and FIG. 14, the amount of the liquid ejected from the nozzle 7 is substantially linear in the first phase (after the activation time $t_1$), and the (colour) density or tone of the pixel 17 will be proportional to the ejected liquid. After several cycles of oscillation, more and more liquid will reach the pixel 17, and the density will gradually reach a saturated phase after a saturation time $t_2$. The saturation time $t_2$ is a statistical value, which is approx. 600 $\mu$s in a tested system, with a nominal pixel diameter of 2 mm. The pixel 17 is considered to be 100% covered with dye after the saturation time $t_2$.

FIGS. 9*a* and 9*b* illustrate how the vibration of the nozzle 7 is suppressed after the ejection of the desired amount. If the nozzle 7 were allowed to vibrate after switching off the driving signal 15, the amplitude may incidentally reach the threshold T even after a few oscillations, and more dye would be ejected than required. This is shown in FIG. 9*a*. To avoid this effect, one or two driving pulses in counter-phase are fed to the transducer before the driving signal 15 is switched off. Thereby the oscillations of the nozzle 7 will subside very fast, practically within one or two cycles, and the discharging of the liquid will end in a definite time. In this manner very well defined and very small amounts of liquid may be dispensed from the nozzle.

Figure 10A:
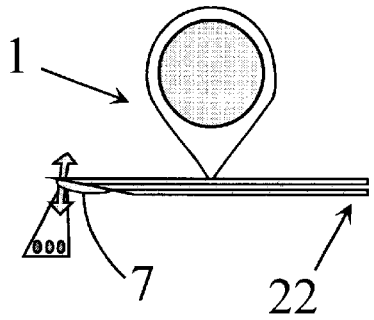
FIGS. 10*a–b* show a pixel unit for mounting in a printing head according to the invention, FIG. 11 show a cross-section across part of a printing head, using the pixel units of FIGS. 10*a–b*.
Figure 10B:
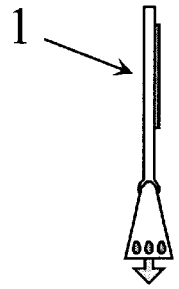
Figure 13B:
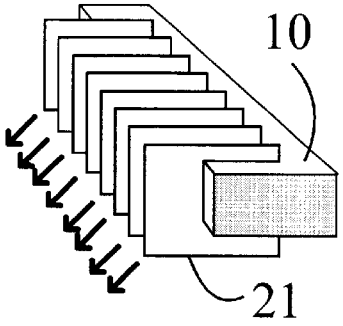

FIGS. 10*a–b*, and FIG. 11 illustrate the structure of the printing head according to the invention. FIGS. 10*a* and 10*b* show a liquid dispensing device 1, substantially equivalent to the embodiment of FIGS. 2*a–b*. A number of such devices 1 are integrated side by side in a printing head 10 (see also FIG. 3.). The printing head 10 comprises parallel slots 20 for receiving the liquid dispensing devices 1. There are provided contact springs 19 for fastening the liquid dispensing devices 1 to the wall of the slots 20. The printing head 10 comprises a common liquid tank 5 (not shown in FIG. 11). The wall of the tank 5 towards the devices 1 are made of resilient rubber, with circular openings, and the input end 22 of the tubes 3 is simply inserted into the openings. This structure is inherently simple, and allow quick and problem-free change of the dispensing devices 1.

FIGS. 12*a–b* and FIGS. 13*a–b* show an alternative, but similar embodiment. Here, the dispensing devices 1 are enclosed in a casing 21, so that a device 1 and a casing 21 together constitute an exchangeable unit within the printing head 10. The casing 21 is provided with an opening 23 at the nozzle, to allow the dispensing of the liquid through the opening 23. This solution is more complicated, but provides better protection to the sensitive nozzles. Also, the pollution of the nozzles and cross-contamination between the nozzles is better prevented.

The liquid dispensing device according to the invention has a number of advantages: It is suitable for dispensing liquids of any kind, be it a solvent or a printing ink. The dispensed quantities of liquid, the weight of the drops as well as the drop repetition rates are variable within a wide range. The device is flat and small which makes it applicable in printing systems, but is able to deliver very fast printing (1–2 m/s). The device and the printing head may be computer-controlled. and no elaborate electric systems are required. The apparatus has a simple mechanical structure which reduces the production costs, and makes cleaning simple, as well as replacing. In order to test the invention, a fully functional prototype have been built. The test results showed that the invention is applicable in practice. It has been demonstrated that the printing head dispenses liquid drops at a specific resonance frequency. The dispensed quantities of liquid are in proportion to the length of the switch-on time, as well as to the amplitude of the vibrations. In practice, the right method of controlling the dispensed quantities of liquid—in printing the ink quantity—seems to be the varying of the switch-on time while the amplitude of the vibrations remain constant.

The invention is not limited to the embodiments shown in the drawings and explained in the description, but is meant to include further embodiments which are obvious to those skilled in the art. E.g. the dispensing device according to the invention is equally suited to dispense other types of liquids than dyes or inks. Especially, dispensing of medicine in small amounts is also considered as a possible application of the inventive concept.

What is claimed is:

1. Device for dispensing liquids, in particular dyes, comprising a liquid tank (5), an elongated, tubular liquid conduit (3) provided with a dispensing nozzle (7), where an end of the liquid conduit (3) is connected to the liquid tank (5) for supplying liquid (6) from the liquid tank (5) to the dispensing nozzle (7), and further comprising vibrator means directly or indirectly operably connected to the nozzle (7) for inducing a vibrating action of the dispensing nozzle (7) transversely to the axis of the liquid conduit (3), wherein the vibrator means is connected to the liquid conduit (3) through a resonator (2), the resonator (2) being formed as a flat metal plate, and the vibrator means is adapted to produce said transversal vibrating action resulting in an acceleration of the nozzle (7) sufficient to cause detachment of the liquid from the nozzle (7) in a direction substantially perpendicular to the conduit (3).

2. The device according to claim 1, wherein the liquid conduit (3) is integral with the dispensing nozzle (7).

3. The device according to claim 2, wherein a free end of the liquid conduit (3) is cut at an angle, and the cut free end functions as the dispensing nozzle (7).

4. The device according to claim 3, wherein the transducer (4) is attached to the liquid conduit (3) through a coupling part 9 of the resonator (2).

5. The device according to claim 4, wherein the resonator (2) is substantially drop-shaped with a circular part (2*a*) having a triangular extension (2*b*) integral with the circular part (2*a*).

6. The device according to claims 4, comprising means for varying the hydrostatic pressure of the liquid (6) in the liquid tank (5) and/or in the liquid conduit (3).

7. The device according to claim 3, wherein the transducer (4), the resonator (2) and the liquid conduit (3) constitute a resonating unit.

8. The device according to claim 3, wherein the transducer (4) is a circular disk-shaped piezoelectric transducer (4), and the steel plate is substantially drop-shaped with a circular part having a triangular extension integral with the circular part, the transducer (4) being attached to parallel to the circular part in a concentric position and the apex of the triangular extension being attached to the liquid conduit (3).

9. A printing head (10) comprising multiple liquid dispensing means for dispensing dye in controlled amounts in predetermined, controlled locations of a printing medium (M), wherein the liquid dispensing means comprises liquid dispensing device (1) according to claim 8.

10. The printing head (10) according to claim 9, comprising parallel slots (20) for receiving the liquid dispensing devices (1).

11. The printing head (10) according to claim 10, further comprising contact springs (19) for fastening the liquid dispensing devices (1) to the wall of the slots (20).

12. The printing head according to claim 9, comprising multiple liquid dispensing devices (1) arranged in a line (L), and further comprising moving means for translating movement of at least the nozzles (7) of the liquid dispensing devices (1) in a direction parallel to the line (L).

13. The printing head according to claim 9, comprising adjustment means for an additional translating movement of the nozzles (7) of the liquid dispensing devices (1) in a direction perpendicular to the line (L), simultaneously or individually for each nozzle (7).

14. The device according to claim 3, further comprising externally controlled driver means for driving the transducer (4) at predetermined, variable frequencies.

15. The device according to claim 1, wherein the vibrator means comprises a piezo-electric transducer (4).

16. The device according to claim 1, wherein the liquid conduit (3) is a hollow metal tube.

17. A printing head (10) comprising multiple liquid dispensing means for dispensing dye in controlled amounts in predetermined, controlled locations of a printing medium (M), wherein the liquid dispensing means comprises liquid dispensing device (1) according to claim 1.

18. The printing head (10) according to claim 17, comprising parallel slots (20) for receiving the liquid dispensing devices (1).

19. The printing head (10) according to claim 18, further comprising contact springs (19) for fastening the liquid dispensing devices (1) to the wall of the slots (20).

20. Printing system with a printing medium (M) feeding mechanism (G,EM,D,R) and at least one printing head (10) for dispensing dye in controlled amounts in predetermined, controlled locations of the printing medium (M), where the printing system includes the printing head (10) according to claim 19.

21. The printing system according to claim 20, the printing system including multiple printing heads, with each printing head dedicated to a predetermined color.

22. Printing system with a printing medium (M) feeding mechanism (G,EM,D,R) and at least one printing head (10) for dispensing dye in controlled amounts in predetermined, controlled locations of the printing medium (M), where the printing system includes the printing head (10) according to claim 17.

23. The printing system according to claim 22, the printing system including multiple printing heads, with each printing head dedicated to a predetermined color.

24. The printing head according to claim 17, comprising multiple liquid dispensing devices (1) arranged in a line (L), and further comprising moving means for translating movement of at least the nozzles (7) of the liquid dispensing devices (1) in a direction parallel to the line (L).

25. Printing system with a printing medium (M) feeding mechanism (G,EM,D,R) and at least one printing head (10) for dispensing dye in controlled amounts in predetermined, controlled locations of the printing medium (M), where the printing system includes the printing head (10) according to claim 24.

26. The printing system according to claim 25, the printing system including multiple printing heads, with each printing head dedicated to a predetermined color.

27. The printing head according to claim 17, comprising adjustment means for an additional translating movement of the nozzles (7) of the liquid dispensing devices (1) in a direction perpendicular to the line (L), simultaneously or individually for each nozzle (7).

28. Printing system with a printing medium (M) feeding mechanism (G,EM,D,R) and at least one printing head (10) for dispensing dye in controlled amounts in predetermined, controlled locations of the printing medium (M), where the printing system includes the printing head (10) according to claim 27.

29. The printing system according to claim 28, the printing system including multiple printing heads, with each printing head dedicated to a predetermined color.

30. Printing system with a printing medium (M) feeding mechanism (G,EM,D,R) and at least one printing head (10) for dispensing dye in controlled amounts in predetermined, controlled locations of the printing medium (M), where the printing system includes the printing head (10) according to claim 17.

31. The printing system according to claim 30, the printing system including multiple printing heads, with each printing head dedicated to a predetermined color.

32. Device for dispensing liquids, in particular inks or dyes, comprising a dispensing nozzle (7), and an elongated, tubular liquid conduit (3) connected to the dispensing nozzle (7), and further comprising vibrator means directly or indirectly operably coupled to the nozzle (7) for inducing a vibrating action of the dispensing nozzle (7) transversely to the axis of the liquid conduit (3), wherein the vibrator means is connected to the liquid conduit (3) through a resonator (2), the resonator (2) being formed as a flat metal plate, and the vibrator means is adapted to produce said transversal vibrating action resulting in an acceleration of the nozzle (7) being sufficient to cause detachment of the liquid from the nozzle (7), in a direction substantially perpendicular to the conduit (3).

33. Device according to claim 32, further comprising means for connection to a liquid tank (5).

34. Device according to claim 32, further comprising a protective casing (21) with an opening (23) to allow the dispensing of the liquid.

35. The device according to claim 32, wherein the vibrator means comprises a piezo-electric transducer (4).

36. The device according to claim 32, wherein the transducer (4), the resonator (2) and the liquid conduit (3) constitute a resonating unit.

37. The device according to claim 32, wherein the resonator (2) is substantially drop-shaped with a circular part (2*a*) having a triangular extension (2*b*) integral with the circular part (2*a*).

* * * * *